United States Patent [19]

Kitamura et al.

[11] Patent Number: 4,867,588

[45] Date of Patent: Sep. 19, 1989

[54] METHOD FOR MANUFACTURE OF A MUTLI-COLOR INK RIBBON INCLUDING INK MIGRATION BARRIER

[75] Inventors: Atsushi Kitamura, 30, Izumi-Hommachi 5-chome, Kanazawa, Ishikawa, Japan, 921; Shigeru Okushima, Ibaragi, Japan

[73] Assignees: Fuji Kagakushi Kogyo Co., Ltd., Osaka; Atsushi Kitamura, Kanazawa, both of Japan

[21] Appl. No.: 140,289

[22] PCT Filed: Mar. 27, 1987

[86] PCT No.: PCT/JP87/00189

§ 371 Date: Nov. 30, 1987

§ 102(e) Date: Nov. 30, 1987

[87] PCT Pub. No.: WO87/05862

PCT Pub. Date: Oct. 8, 1987

[30] Foreign Application Priority Data

Mar. 27, 1986 [JP] Japan ..... 61-69467

[51] Int. Cl.[4] ..... B41J 31/00

[52] U.S. Cl. ..... 400/240.2

[58] Field of Search ..... 400/240, 240.1, 240.2, 400/240.3, 240.4

[56] References Cited

U.S. PATENT DOCUMENTS

| | | | |
|---|---|---|---|
| 2,711,779 | 6/1955 | Carland | 400/240.2 X |
| 2,728,439 | 12/1955 | Murphy et al. | 400/240.2 X |
| 3,981,387 | 9/1976 | Gottschlich | 400/240.2 X |
| 4,476,176 | 10/1984 | O'Neil | 400/240.2 X |

FOREIGN PATENT DOCUMENTS

| | | | |
|---|---|---|---|
| 51-65012 | 11/1976 | Japan . | |
| 54-134516 | 3/1979 | Japan . | |
| 58-140285 | 8/1983 | Japan . | |
| 59-164176 | 9/1984 | Japan . | |
| 59-201887 | 11/1984 | Japan . | |
| 60-14712 | 4/1985 | Japan . | |
| 0241181 | 10/1986 | Japan | 400/240.2 |

OTHER PUBLICATIONS

IBM Technical Disclosure Bulletin, "Barrier for 4–Color Inked Ribbon", Bergacs III, et al., vol. 26, No. 7A, Dec. 1983, p. 3437.

IBM Technical Disclosure Bulletin, "Laser Method of Producing Multicolored Nylon Typewriter Ribbon", Fursik et al., vol. 26, No. 12, May 1984, p. 6602.

IBM Technical Disclosure Bulleting, "Ink Barrier for a Multicolor Printer Ribbon", Nash et al., vol. 27, No. 3, Aug. 1984, p. 1824.

*Primary Examiner*—Ernest T. Wright, Jr.

*Attorney, Agent, or Firm*—Armstrong, Nikaido, Marmelstein, Kubovcik & Murray

[57] ABSTRACT

The invention relates to borderline formation on a multi-color ink ribbon for use on a typewriter or impact type printer.

The ink-impervious borderline is formed by melting the fiber in the corresponding linear zone of the substrate fabric by irradiation with thermal radiation, specifically, an oblong laser beam, without physical contact.

1 Claim, 1 Drawing Sheet

METHOD FOR MANUFACTURE OF A MUTLI-COLOR INK RIBBON INCLUDING INK MIGRATION BARRIER

TECHNICAL FIELD

This invention relates to a multicolor ink ribbon for a typewriter or printer provided with a mechanism for impact printing.

BACKGROUND ART

As multi-color ink ribbons for use with a typewriter or the impact type printers of word processors, computers and other devices, there are known a two-color ink ribbon comprising a textile substrate saturated with black and red liquid inks on both sides of an ink-resistant borderline and a four-color or other multi-color ink ribbon comprising a substrate fabric similarly saturated with, for example, black, cyan, magenta and yellow liquid inks.

This type of multi-color ink ribbon has the drawback of "migration", an intermingling of the inks of different colors from the adjacent ink-saturated lanes during storage, distribution or use and a variety of preventive countermeasures have been proposed.

For example, the Japanese Official Gazette of Utility Model Laid-open Application No. 65012/1976 discloses the art of forming such a borderline between ink-saturated lanes by a hot melting technique or by impregnation with a plastic composition.

The Japanese Official Gazette of Patent Laid-open Application 128412/1978 discloses the art of forming such a borderline by causing the substrate fabric to contact a thermal means such as a hot roller or the like.

The Japanese Official Gazette of Utility Model Laid-open Application No. 134516/1979 teaches the technique of forming a borderline wherein the substrate fabric is melted under pressure by means of the pressure tip of an ultrasonic welder.

The Japanese Official Gazette of Patent Laid-open Application 140285/1983 teaches the technique of forming a borderline by coating the substrate fabric with a water repellent agent such as silicone oil, paraffin, wax, a fluorine-containing resin, or the like.

However, the method in which the borderline is formed by coating the substrate fabric with a plastic material or a water repellent agent is disadvantageous in that if one tries to assure a sufficient penetration of the coating agent into the substrate fabric to prevent formation of pinholes, the coating agent will diffuse too much into the substrate so that a broad ink-resistant zone is formed in the substrate fabric. As a result, the ribbon must have a fairly large width and this, in turn, makes it essential to scale up both the ribbon feed mechanism and the shifting mechanism for color change. Furthermore, it is technically difficult to accurately construct a borderline of uniform width by any of such coating techniques.

The method of forming a borderline by melting the substrate fabric with a heating means such as the hot roller or pressure tip of a high frequency welding machine is disadvantageous in that the heating means picks up the molten masses of the substrate to cause an irregular travel of the fabric and a variation in heating temperature. Such troubles result in a local under-melting or over-melting at the points of contact so that pinholes are formed in the borderline to cause a migration of inks from the adjacent ink-saturated lanes.

In addition, as shown in FIG. 4 which is a partially expanded view (a schematic tracing of a micrograph) showing the borderline formed by the above method employing a heating means, a portion of the melted fiber collects and is solidified to form resin build-ups 5*a* along both edges of the borderline (5) and these resin build-ups 5*a* tend to interfere with the operation of the ribbon shift guide during the use of the ink ribbon or cause an instability of the direction of travel; the result is irregular traveling. In FIG. 4, the numeral 3 denotes the substrate fabric, 3*a* the warp fiber of the same, 3*b* the weft fiber of the same, and 5 the borderline.

It is an object of this invention to provide a multi-color ink ribbon free of the above-mentioned disadvantages. It is another object of this invention to provide a method for manufacturing such a multi-color ink ribbon.

DISCLOSURE OF INVENTION

This invention consists in a multi-color ink ribbon comprising a substrate fabric constructed of heat-meltable fiber and saturated with liquid inks of different colors in distinct lanes separated by one or more borderlines from each other, each of said borderlines being an ink-impervious linear zone formed by melting the fiber corresponding thereto under no compressive stress.

This invention also consists in a method of producing a multi-color ink ribbon comprising a substrate fabric constructed of heat-meltable fiber and saturated with liquid inks of different colors in distinct lanes separated by one or more borderlines from each other, which comprises melting the fiber in a linear zone corresponding to each of said borderlines by irradiation with thermal radiation without physical contact.

This invention is described below in further detail.

The substrate fabric to be employed in this invention is a textile material constructed of heat-meltable fiber.

As the heat-meltable fiber mentioned above, various filament fibers of heat-meltable materials such as nylon 6, nylon 66, polyester and so on can be employed.

Formation of the borderline can be effected by irradiating the corresponding linear zone of the substrate fabric with thermal radiation, whereby the fiber in said linear zone is melted without physical contact to form an ink-impervious borderline.

Upon the above irradiation, the fiber in the borderline-forming zone melts under no compressive stress, whereby an ink-impervious linear zone is formed.

The thermal radiation may be a beam of infrared light or laser light, for instance, but the use of laser light is particularly beneficial for commercial purposes.

As the laser source or oscillator, there may be employed any of a carbon dioxide gas laser (wavelength 10,600 nm), ruby laser (694 nm), YAG laser (10,600 nm), glass laser (1,065 nm), He-Ne laser, semiconductor laser, and so on.

The laser oscillator is driven and controlled to output a narrow beam of, for example, about 0.1 to 0.2 mm in diameter and projected through an appropriate optics to the substrate fabric traveling at a constant speed. Depending on cases, the diameter of the laser beam may be less than 0.1 mm or in excess of 0.2 mm.

In irradiating the substrate fabric with a laser beam, an accurate borderline can be formed with good reproducibility when the laser light is deformed into an oblong beam by means of a dome-shaped lens and projected to the substrate fabric with the major axis of the oblong beam oriented in the direction of travel of the substrate fabric.

The incident angle of laser light on the substrate fabric is generally 90 degrees but the irradiation may be carried out at an inclination of, for example, 30°, 45° or 60°.

The direction of travel of the substrate fabric for the purpose of irradiation may be vertical, horizontal or oblique.

The formation of a borderline by irradiation with such a thermal radiation is preferably carried out prior to saturation of the fabric with liquid inks from the standpoint of preventing color migration but may be performed simultaneously with the saturation procedure or after the same procedure.

Liquid inks of various colors can be used for saturation of the substrate fabric. For example, the two-color combination of black and red, the three-color combination of black, red and magenta and the four-color combination of black and the three primary colors, namely cyan, magenta and yellow. In the case of the 4-color combination last mentioned, the blue, green and red colors are produced by the superimposition of cyan and magenta, cyan and yellow, and magenta and yellow, respectively, and these 7 colors plus the white background of the printing paper (8 colors in total) constitute the prints of characters, pictures, graphs and so on.

In the multi-color ink ribbon according to this invention, the fiber forming the linear zone corresponding to said borderline is melted without physical contact to form an ink-impervious linear pattern. Thus, the molten fabric material fills the inter-fiber voids and is solidified in situ to thereby positively prevent the diffusion of liquid inks to the neighboring ink-saturated lanes.

As shown in the partially enlarged cross-section view (a schematic tracing of a micrograph) showing the multi-color ink ribbon of this invention in FIG. 1, the selective melting of the substrate fabric with thermal radiation without physical contact does not give rise to the resin pooling and build-ups which are produced along the edges of the borderline when the conventional contact method is employed, so that a stable travel of the fabric is assured during the formation of the borderline or in use of the ink ribbon. In FIG. 1, the reference numeral 3 represents the substrate fabric, 3*a* the warp fiber thereof, 3*b* the weft fiber thereof, and 5 the borderline.

This invention provides the following effects.

In the multi-color ink ribbon of this invention, the borderline assures a positive prevention of diffusion of liquid inks into the neighboring ink-saturated lanes.

In addition, since the melt does not collect and coagulate to form buildups along edges of the borderline of the multi-color ink ribbon, the travel of the substrate fabric in the borderline forming stage and the travel of the product ink ribbon are both very smooth.

Particularly when the laser beam used as the thermal radiation is deformed into an oblong beam by means of a dome-shaped lens before it is incident on the fabric and projected with the major axis of the oblong beam oriented in the direction of travel of the substrate fabric, a narrow or very narrow borderline can be produced with good reproducibility without the under-melting or over-melting problem.

Figure 1:
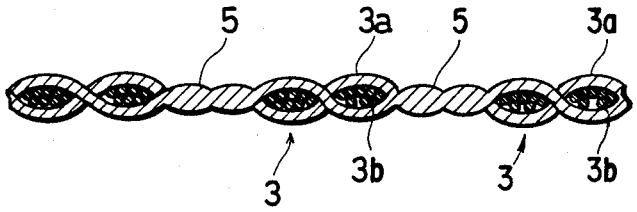
FIG. 1 is a partially enlarged cross-section view (a schematic tracing of a micrograph) showing the multi-color ink ribbon of this invention.

In the figures, the following reference numerals or symbols are used:

(1)—laser oscillator; (2)—lens (dome-shaped lens); (3)—substrate fabric; (3*a*)—warp fiber; (3*b*)—weft fiber; (4)—laser beam; (5)—borderline; (5*a*)—build-up.

BEST MODE FOR CARRYING OUT THE INVENTION

The following embodiments are further illustrative of this invention.

EXAMPLE 1

Figure 2:
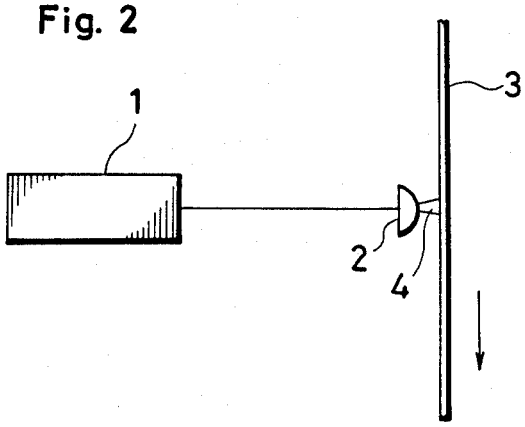
FIG. 2 is a schematic side elevation view outlining the apparatus for practicing the method of this invention.

FIG. 2 is a schematic side elevation view outlining the apparatus for use in the working of the method of this invention.

Figure 3:
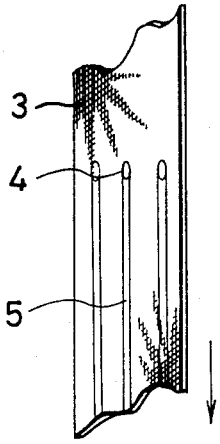
FIG. 3 is a perspective view showing the cardinal parts involved in the practice of the method.
Figure 4:
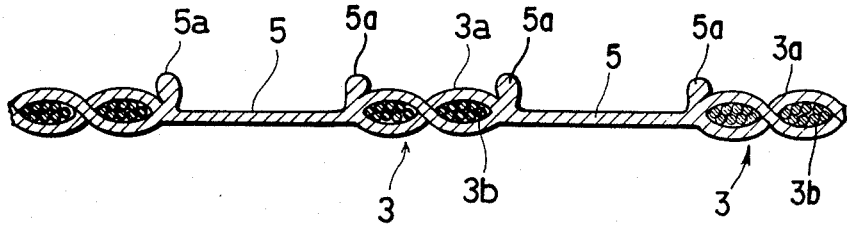
Fig. 4 PRIOR ART
FIG. 4 is a partially enlarged cross-section view (a schematic tracing of a micrograph) showing the borderline formed by the heating element contact method.

FIG. 3 is a generalized perspective view illustrating the practice of the method of this invention.

The reference numeral 1 represents a laser oscillator and the numeral 2 represents a dome-shaped lens as an example of the optics used in the method of the invention.

Indicated at 3 is a substrate fabric traveling in the vertical direction indicated by the arrowmark. The fabric 3 is a woven fabric of nylon 6 filaments, which is an example of the heat-meltable fiber to be used in this invention.

The reference numeral 4 designates a laser beam deformed to assume an oblong cross-section. The borderline formed by irradiation with the above-mentioned beam 4 is indicated at 5.

The beam output from the laser oscillator 1 is deformed by the lens 2 into an oblong beam 4 which is incident on the substrate fabric 3 where it melts the fiber in the zone corresponding to the borderline 5 to be formed without physical contact and under no compressive load.

As the traveling substrate fabric 3 is thus irradiated with the oblong laser beam 4, a borderline 5 with a line width of 0.2 mm is produced in the irradiated zone.

When the lane of the substrate fabric 3 on one side of the above borderline 5 is saturated with black liquid ink and the lane on the other side with red liquid ink, the diffusion of each ink is arrested exactly at the edge of the borderline 5. Neither of the inks diffuses into the borderline 5 so that the borderline 5 remains as white as it has been.

In an experiment in which, after the two lanes on both sides of such a borderline 5 were saturated with dye-based liquid inks and one of the lanes was used, there occurred no capillary diffusion of the ink from the unused lane into the consumed lane.

The traveling characteristic of the fabric 3 during the borderline forming stage and that of the product ink ribbon were also investigated. It was found that, in both cases, the traveling stability was excellent.

Industrial Applicability

The multi-color ink ribbon according to this invention is of great benefit as the typewriter ribbon or as the ribbon for the impact type printers of word processors, computers and other devices.

We claim:

1. In a method of producing a multi-color ink ribbon comprising a substrate fabric constructed of heat-meltable fiber and saturated with liquid inks of different colors in distinct lanes seperated by one or more borderlines from each other, which comprises melting the fiber in a linear zone corresponding to each of said borderlines by irradiation with laser light radiation without physical contact, the improvement comprising passing the laser light through a dome-shaped lens to give an oblong beam and projecting the oblong beam to the substrate fabric with the major axis of the oblong beam oriented in the direction of travel of said substrate fabric.

* * * * *